United States Patent [19]

Bührer

[11] 3,968,830

[45] July 13, 1976

[54] MOLDING APPARATUS FOR COMPRESSING AND VIBRATING FOUNDRY MOLDS

[76] Inventor: Erwin Bührer, Vogelingasschen 40, Schaffhausen, Switzerland

[22] Filed: Nov. 26, 1974

[21] Appl. No.: 527,188

[30] Foreign Application Priority Data

Dec. 6, 1973 Switzerland ..... 17150/73

[52] U.S. Cl. ..... 164/196; 164/207

[51] Int. Cl.[2] ..... B22C 15/30

[58] Field of Search ..... 164/196, 197, 182, 183, 164/184, 187, 203, 289, 200, 201, 202, 207, 212, 210, 211

[56] References Cited

UNITED STATES PATENTS

| | | | |
|---|---|---|---|
| 867,104 | 9/1907 | Bonvillain et al. | 164/184 |
| 1,387,942 | 8/1921 | Pettersson | 164/211 |
| 1,676,201 | 7/1928 | Wood | 164/187 |
| 1,890,933 | 12/1932 | Bullock | 164/207 X |
| 2,892,223 | 6/1959 | Buhrer | 164/211 X |

FOREIGN PATENTS OR APPLICATIONS

| | | | |
|---|---|---|---|
| 958,269 | 5/1964 | United Kingdom | 164/211 |

*Primary Examiner*—Francis S. Husar
*Assistant Examiner*—John S. Brown
*Attorney, Agent, or Firm*—Toren, McGeady and Stanger

[57] ABSTRACT

Foundry molds may be compressed and vibrated between a vibration table and a presser plate within apparatus which is structured to enable connection of the vibration table and the presser plate as a rigid frame during the compression and vibration process. The coupling means forming the rigid frame include locking means which may be actuated between a locked and an unlocked position whereby a gap may be formed when the coupling means are in the unlocked position to enable foundry molds to be swung in place by horizontally extending arms to effect location of the foundry molds between the vibration table and the presser plate. Damper means are also provided which damp and limit the movement of the presser plate and its associated pressure applying means in both an upward and a downward direction. In one embodiment the coupling means may comprise a vertically displaceable rod which may be actuated between a locked and an unlocked position between the presser plate and the vibration table, while in a second embodiment a swiveled lever involving a tongue-in-groove arrangement may perform the locking and unlocking function.

12 Claims, 11 Drawing Figures

113
117
111
112
121
109
110
119
120
114
103
104
105
106
108
102
107
41
115
34
118
122
40
116

88
91
90
87
95
89
88
VIII
85
87
93
92
89
95
VIII
25
VII
86
79
78
75
94
74
74
73
81
80
83
82
74
74
74

4
84
75
76
VI
VI
73
74
77
74

MOLDING APPARATUS FOR COMPRESSING AND VIBRATING FOUNDRY MOLDS

BACKGROUND OF THE INVENTION

The present invention relates generally to molding apparatus and more particularly to a molding machine wherein foundry molds may be simultaneously compressed and vibrated between a vibration table and a presser plate.

In prior art devices, it has been known to produce foundry molds by effecting a desired distribution of the granular molding material in a process which involves compression and jarring or vibration of the mold assembly. In some cases, a vibration operation is followed by a subsequent compression step while in other cases simultaneous vibration and compression may be performed after an initial compression operation.

Experience indicates that an economical way of producing a mold consists of compressing the granular material of the mold by squeezing together the mold parts. However, the disadvantage of this type of production process is that the compressive forces produced above the mold patterns is usually too great while the forces created in the dividing plane of the mold is low. Particularly, it has been found that the compressive forces effected between the patterns and the edges of the mold in the dividing plane are unsatisfactory.

If the mold granular material is only compressed by jarring during the production of the foundry mold, the compression which is effected is insufficient. It has therefore been common to produce a mold by effecting an initial compression thereof in a first operation utilizing a jarring technique and by completing the compression in a subsequent operation which involves squeezing or impact molding. Impact molding usually involves the application of impact forces by a jarring piston to either the squeezer board, the molding table or both during and simultaneously with the squeezing process. However, it has been found that the granular material which is to be compressed does not change its state of motion or its state of rest. In this connection reference is made to U.S. Pat. No. 1,814,416.

This type of foundry mold production technique exhibits considerable differences in the compression of the granular material. Again, it is found that the degree of compression is overly high above the molding patterns while compression in the dividing plane of the mold, particularly between the patterns, drops sharply. As a result, the degree of utilization of the mold surface is reduced because, in order to improve the compressive effects between the patterns, the distance between the patterns must be selected to be greater than is desired.

Uniform compaction of the granular material may be achieved in a process which involves preliminary compression of the granular material in a first operation with completion of the compression being performed in a second operation involving simultaneous jarring and squeezing. This type of production technique not only yields the most uniform compaction of the granular material, particularly at the edges of the dividing plane, but it also permits selection of smaller pattern intervals on the pattern plate thereby enabling substantial improvement in the utilization of the mold surface.

Attempts have been made at an early stage to effect compaction of the granular material by simultaneous vibration and compression by utilizing an adjacent press to exert upon the granular material a squeezing pressure during the jarring operation. In this connection reference is made to British Pat. No. 571,188 and particularly to lines 40–43 on page 2 thereof. The lifting force of the jarring piston must be selected great enough that it may lift, in addition to the weight of the mold table and of the parts connected thereto, the squeezing pressure acting additionally upon the granular material. However, the above mentioned device for simultaneous jarring and squeezing, which in itself may be quite simple, is not applicable in a practical sense because the falling movement during the jarring process exceeds the acceleration due to gravity. This produces the result that all the parts are not rigidly connected with the jarring table just at the time that the molding box, the sand frame and the like are lifted from the molding table during the jarring operation.

Additionally, vibratory molding apparatus is known which involves a squeezer board operating under a liquid or air pressure wherein the squeezing device is carried by a jarring table for the purpose of vibration-compression. A squeezing or compression device is arranged on a swivel squeezing plate which bears over a column upon the jarring table. The swivel squeezing board may be swung into an operating position over the jarring table after the molding box has been attached and the box has been filled with the granular material. On the opposite side of the squeezing board there is arranged a tie-rod which is articulated to the jarring table when the squeezing board is swung into place so that a portal is formed above the jarring table to absorb the squeezing pressure. (See German Pat. No. 531024.) This type of molding machine intended for the simultaneous vibration and compression of a mold has been found unacceptable from the practical point of view because the necessary forces for swinging the vibration-compression machinery in and out of position, and thus the time required for this operation, render practical application thereof unlikely.

Molding equipment is also known wherein a press is arranged upon a pivotable arm which is mounted upon a column and which is connected over a support and a bolt with both a jarring cylinder and with a jarring table. (See British Pat. No. 350020, particularly lines 18–25 on page 5 thereof.) This type of molding equipment not only involves disadvantages similar to those of the device disclosed in German Pat. No. 531024, but it also includes the additional disadvantage that the compression pressures which already amount to several tons for small molds if they are to be effective, can no longer be applied in the form of a yoke with a great sweep.

Furthermore, a molding machine for effecting jarring and squeezing, or both, is known wherein a press is articulated to a mold table or the parts are connected to the mold table only during compression or vibration-compression but otherwise has no physical contact therewith. (See Swiss Pat. No. 315945.) This molding machine has the disadvantage that the press must, in one case, be swung out for attaching the molding box, filling and precompressing of the granular material by jarring, and subsequently it must be swung in again over the mold table for final compression by jarring or by jarring and squeezing. Thus, in this case there also arise the aforementioned disadvantages related to the devices described in German Pat. No. 531024 and in British Pat. No. 350020. This molding machine, however, can also be built for use in an application which involves operation of the device in a carousel fashion wherein a turntable carries several jarring units with the respective jarring tables, pattern devices and molding boxes. In this case, several operations are performed in the successive stages which involve (1) attachment of the molding box on the complete pattern device, (2) filling-in and precompression of the granular material by jarring, (3) final compression by jarring or by jarring and squeezing, and (4) lifting of the mold from the pattern device in a final stage of operation. This last application has the disadvantage that extremely large masses must be moved since several jarring units with the pattern devices, the molds or molding boxes, must be arranged on the turntable. This type of molding machine therefore involves the disadvantage that it requires a rather complicated drive since large forces must be transmitted, so that an inordinately high cost is involved in the maintenance and operation of the device. Experience has shown that the mold sizes for molding on molding machines becomes increasingly larger. Consequently, the dimensions and weights which these molding machines require become so great that they can only be produced in relatively few machine plants.

Thus, it will be seen, that with prior art devices, disadvantages and difficulties will arise in connection with the practical application of known techniques where compression and vibration of a mold, either separately or simultaneously, is to be effected. The present invention is intended to eliminate many of the difficulties and disadvantages of the prior art and to provide equipment which is practical in its application and effective in its use. By the present invention, handling of foundry molds during compression and/or vibration thereof is simplified and the size and weight of the structural parts which are required are reduced. Additionally, lower driving forces may be utilized and the costs of operation and maintenance of equipment is also reduced.

SUMMARY OF THE INVENTION

Briefly, the present invention may be desired as molding apparatus for compressing and vibrating foundry molds comprising, in combination, a vibration table adapted to have the molds placed thereupon, means for vibrating the table, presser means including a presser plate and pressure applying means located at a spaced distance above the vibration table, with the presser means being movable between an uppermost position and a lowermost position. With the presser means in the uppermost position, placement of molds between the vibration table and the presser plate is enabled. Subsequently, the presser means are moved to their lowermost position and application of a compressive force to the molds may be applied with simultaneous vibration of the molds by the presser plate equipment. The apparatus includes horizontally extending arms which are adapted to have the molds supported thereon, with mounting means being provided for the arms to effect rotation of the arms for placing the molds into and out of operative position between the vibration table and the presser plate. The invention particularly comprises coupling means extending between the presser means and the vibration table to enable formation of a rigid frame or portal structure therebetween. The coupling means includes locking means which are movable between a locked and an unlocked position. With the locking means in the unlocked position, a gap is formed in the overall frame structure which includes the presser means and the vibration table thereby enabling movement of the foundry mold support arms through the gap whereby the molds may be placed in their operative position for compression and vibration. Subsequently, the locking means may be moved to their locked position and the molds may be compressed and vibrated between the vibration table and the presser means.

The invention includes damper means which operate to damp and limit both the upward and downward movement of the presser means.

In one embodiment of the invention, the locking means are formed with a vertically movable locking rod which may be raised to unlock the locking means thereby to form a gap permitting movement therethrough of the foundry mold support arms and placement of the molds in their operative position. In this embodiment, a bayonet type of locking arrangement is provided.

In another embodiment of the invention, the locking means may be configured to comprise a swiveled lever and a tongue-in-groove locking arrangement whereby pivoting of the swivel lever out of locking engagement operates to form a gap enabling movement therethrough of the arms carrying the foundry molds to enable placement of the molds into operative position. Subsequent swiveling or pivoting of the swivel lever into the locked position effects formation of the rigid frame between the presser plate and the vibration table with the molds therebetween.

The various features of novelty which characterize the invention are pointed out with particularlity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENTS

Figure 1:
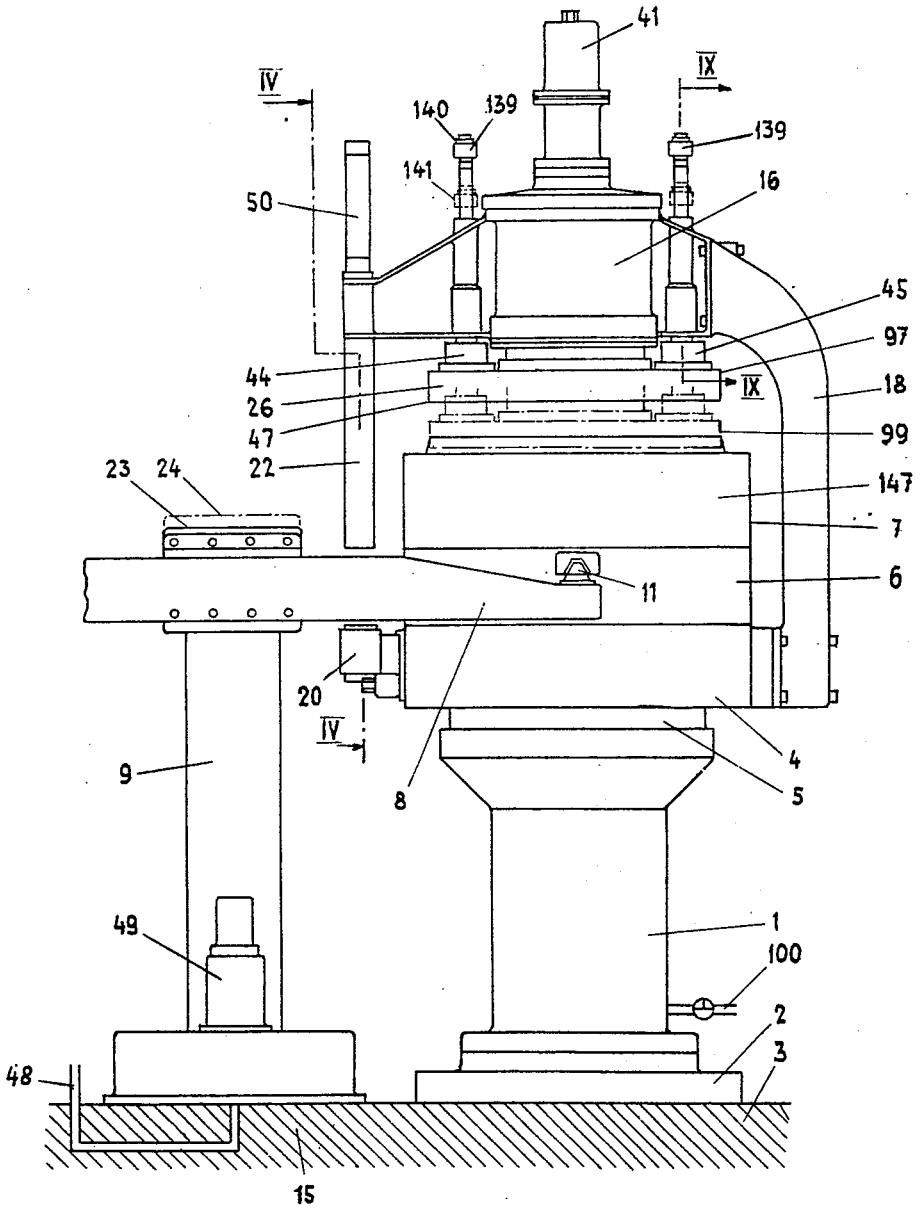
FIG. 1 is a view in side elevation showing a molding machine viewed in a direction taken along the arrow I in FIG. 2.
Figure 2A:
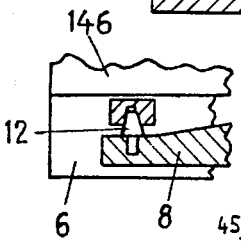
FIG. 2*a* is a sectional view taken along the line II*a*—II*a* of FIG. 2.
Figure 2:
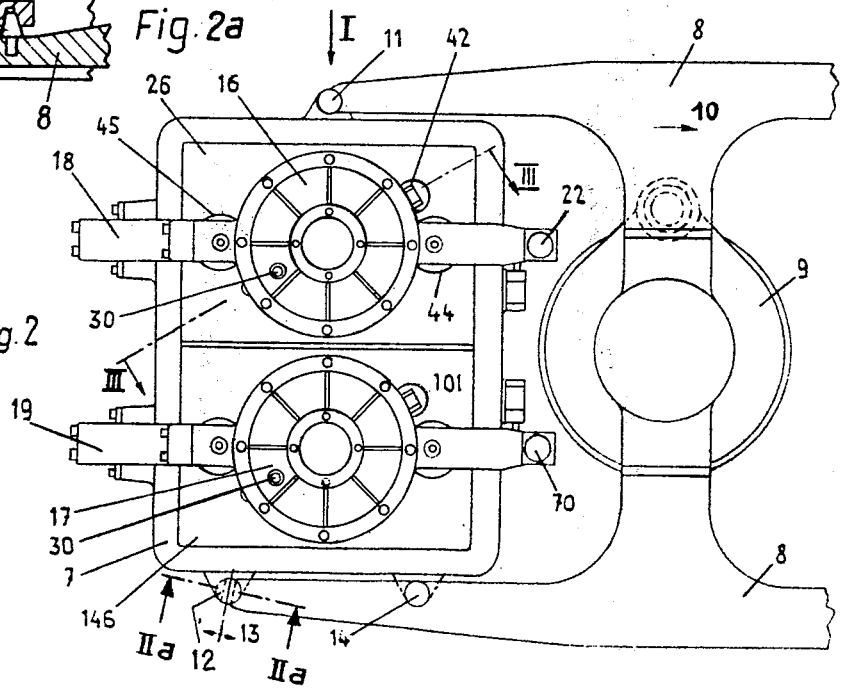
FIG. 2. is a top view of the device of FIG. 1.

Referring now to the drawings, there is shown in FIGS. 1 and 2 the overall structure of molding equipment embodying the present invention. The equipment is supported upon a base or foundation 3 upon which there is positioned a pedestal or base plate 2 of the device with vibration means 1 extending thereabove. The vibration means 1 includes equipment for effecting vibratory motion of a vibration table 4 which is positioned above the vibrating means 1 with a damping ring 5 located therebetween. A foundry mold 147 including a pattern device 6 and a molding box 7 is located above the vibration table 4. The pattern device 6 is arranged to be lifted and moved relative to the vibration table 4 by arm means 8 which are supported for movement upon mounting means 9 which comprise a lifting device bearing upon a portion 15 of the lower foundation of the equipment. The arms 8 may be swung into and out of position in the direction of the arrow 10 shown in FIG. 2.

The mounting means 9 operates to move the arms 8 between a raised position 24 and a lowered position 23. In the operation of the mounting means 9 and the arms 8, a plurality of pattern devices such as the pattern device 6 may be conveyed into and out of operative position and although a pattern device 6 is shown in the drawing, another pattern device arranged opposite this pattern device may be moved into place over the vibration table 4 and deposited thereupon when the mounting means 9 and the arms 8 are in the elevated position 24.

In the elevated position, the pattern device 6 bears upon one side of a conical centering pin 11 which is arranged on an arm 8. The pattern device 6 is supported on its opposite side by the arms 8 by means of a bolt 12 which comprises prism shaped surfaces that secure the position of the pattern device 6 on opposite prism shaped surfaces in the direction of an arrow 13, while the pattern device 6 bears upon a horizontal surface by means of a bolt 14. Thus, a three-point support is provided and by means of this three-point support of the pattern device 6 on the arms 8 it is possible to lower the pattern device 6, while it is secured in position, on the vibration table 4 and also to lift it therefrom. Swinging movement of the arms 8 in the direction of the arrow 10 about a vertical axis of rotation defined through the lifting device 9 may be effected manually by bringing the device against a stop (not shown). The lifting device 9 may also be provided with suitable drive means. Furthermore, it is also possible to arrange the lifting device 9 to carry one only of the pattern devices 6 or a plurality of such pattern devices in a carousel arrangement.

As will be seen from FIG. 2, molding equipment for the production of larger molds may be provided with a pair of presser means 16 and 17 incorporating therein pressure applying means for compressing molds. The presser means 16 include a presser plate 26 arranged to have the foundry molds placed between the presser plate 26 and the vibration table 4. The presser means 16 and the vibration table 4 are arranged to have formed therebetween coupling means, to be further described hereinafter, whereby a rigid frame assembly may be formed between the presser means 16 and the vibration table 4.

The coupling means include rigid column means 18 arranged to fixedly connect the vibration table 4 with the presser means 16. Similar rigid column means 19 are arranged to fixedly connect the presser means 17 with the vibration table 4.

Figure 4:
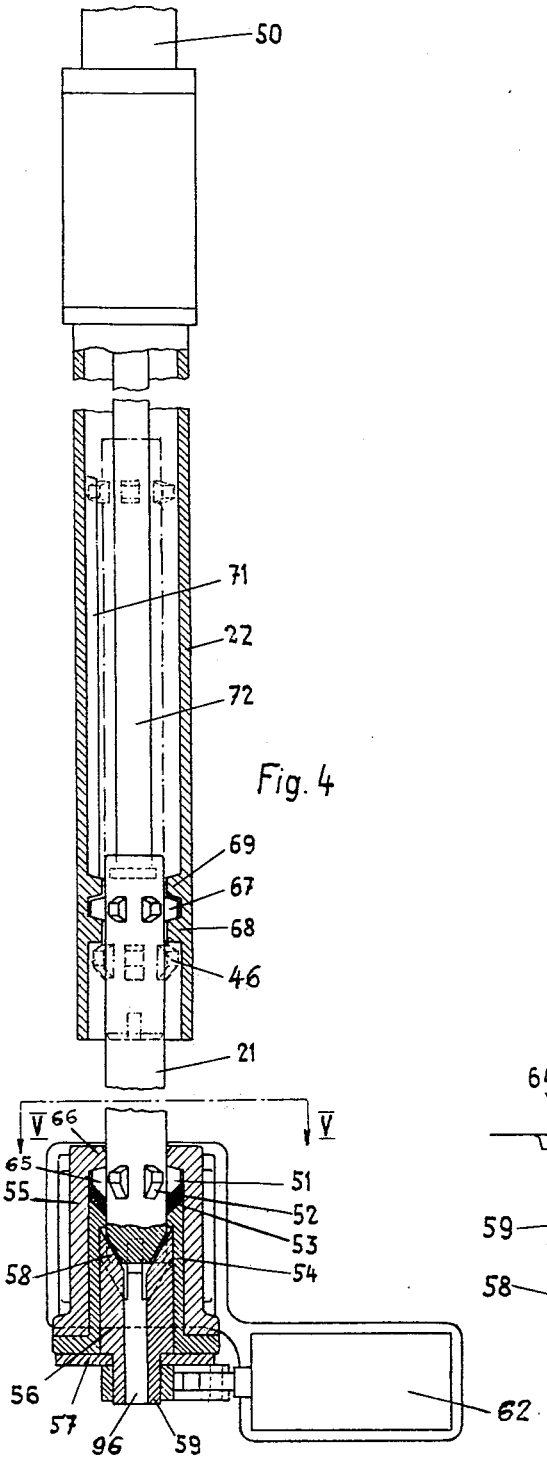
FIG. 4 is a sectional view taken along the line IV—IV of FIG. 1 showing the locking means of one embodiment of the invention.

The coupling means include locking means which comprise a clasping device 20 which is rigidly connected to the vibration table 4 and which may be fixedly locked by means of a coupling member 21, shown in FIG. 4, which is mounted for vertical and rotational displacement in a hollow column 22 rigidly connected with the presser means 16. It will be seen that the rigid column means 18, the presser means 16, the hollow column 22, the clasping means 21 and the coupling member 20 form, in the coupled state, a rigid frame which includes the vibration table 4. In the same manner, the rigid column means 19, the presser means 17 and their respective parts similar to those parts described above, are adaptable to form a similar rigid frame including the vibration table 4 when the appropriate parts are in their coupled state.

The mounting or lifting device 9 is in its lowered position 23 when the coupling means of the present invention are in their coupled state and the pattern device 6 is arranged with its attached molding box 7 filled with granular material upon the vibration table 4.

Figure 5:
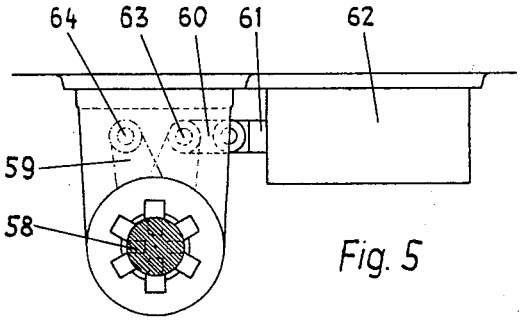
FIG. 5 is a partial sectional view taken along the line V—V of FIG. 4.

The apparatus depicted in FIG. 1 is shown to include a coupling device in accordance with the embodiment thereof depicted in FIGS. 4 and 5 which includes a displaceable and rotatable coupling member 21. However, another embodiment of the coupling means of the present invention shown in more detail in FIGS. 6, 7 and 8, may be alternatively utilized and in this embodiment there is provided a coupling arrangement which includes a swiveled lever 25. Both the coupling means according to FIGS. 4 and 5, and the coupling means according to FIGS. 6, 7 and 8, will be described in more detail hereinafter both as to their structure and as to their mode of operation.

Figure 3:
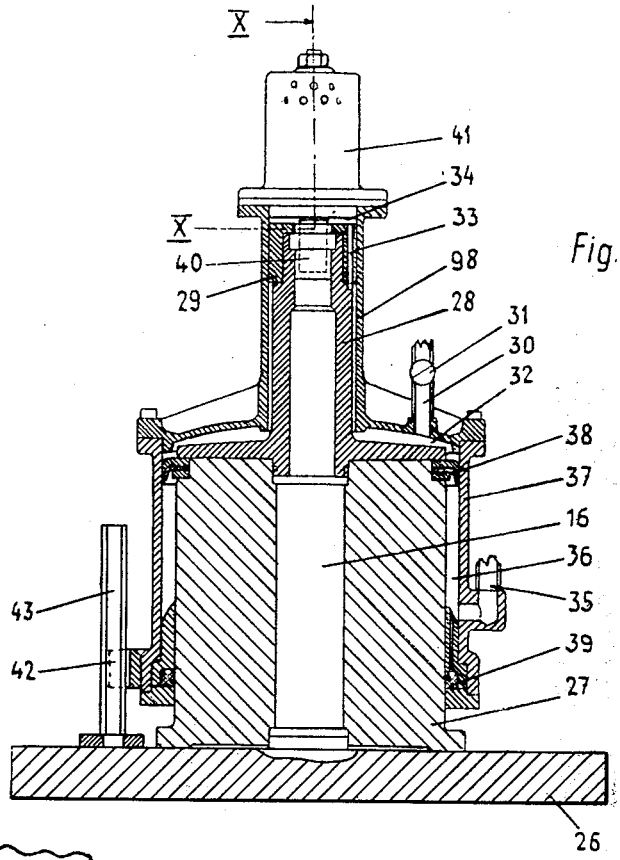
FIG. 3 is a sectional view taken along the line III—III of FIG. 2.

The presser means 16 of the invention are shown in more detail in the sectional view of FIG. 3 as including a presser board or plate 26, a presser piston 27, and a member 28 attached to the piston 27 which carries another presser piston 29. Compressed air may be fed through a compressed air line 30 by means of a control valve 31 to an interior section 32 of a cylinder 37. The cylinder interior 32 is also connected through ducts 33 with a space 34 located above the presser piston 29. Compressed air may be constantly supplied through a compressed airline 35 to the annular space 36 located within the cylinder 37 between the presser piston 27 and the interior wall of the cylinder 37. The annular space 36 is sealed by packing means 38 and 39 such that, when the cylinder interior space 32 is devoid of pressure there may be effected lifting of the presser board or plate 26 together with the presser piston 27, the member 28 and the presser piston 29 until lifting movement is stopped by a bolt 40 of a damper 41 attached upon the presser means 16.

The annular space 36 thus assumes the function, after compression is completed, of returning the presser piston once again to its original position. A guide element 42 shown also in FIG. 2, secures the presser board 26 over a bar 43 rigidly connected with the board 26 against turning relative to the presser means 16 and thus also against turning relative to the vibration table 4 with which the presser means 16 is connected.

Figure 9:
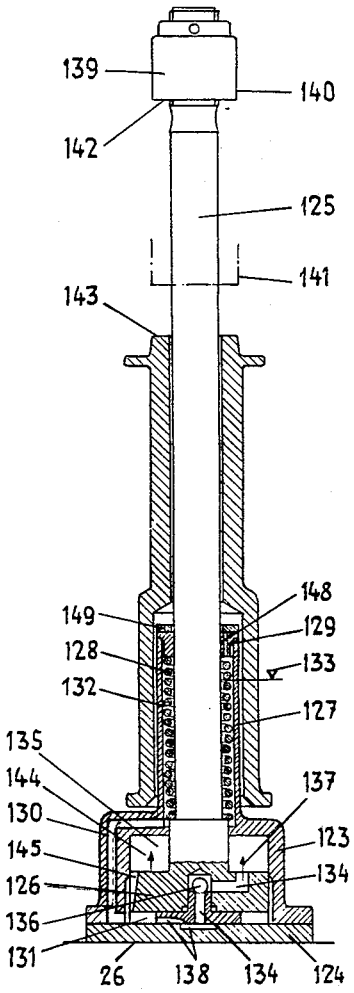
FIG. 9 is a sectional view taken along the line IX—IX of FIG. 1 showing one type of damper used in the present invention.
Figures 6, 7, 8, 10:
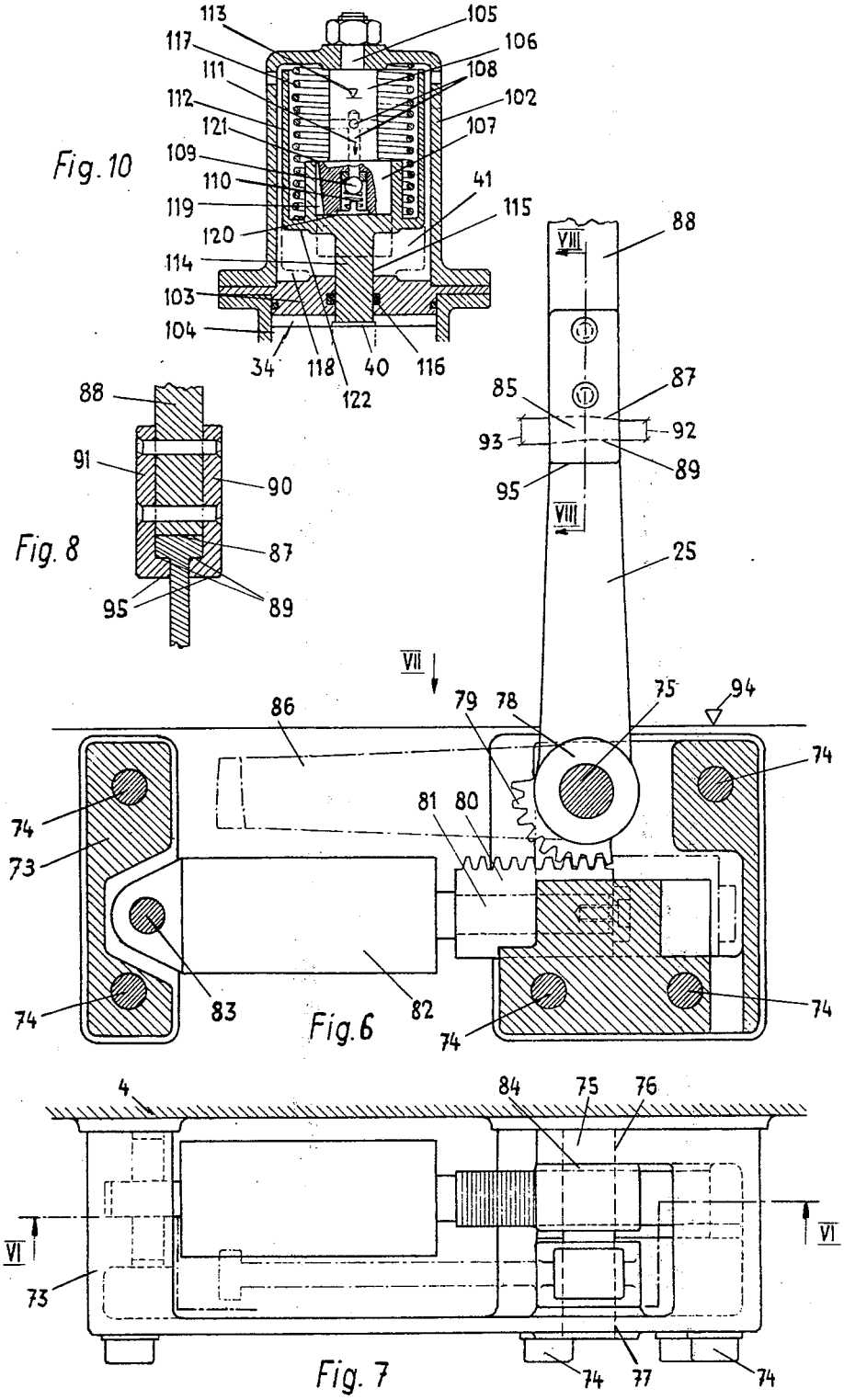
FIG. 6 is a side view taken along the line VI—VI of FIG. 7 showing another embodiment of the locking means of the present invention.
FIG. 7 is a top view of the locking means of FIG. 6 viewed in the direction of an arrow VII shown in FIG. 6.
FIG. 8 is a partial sectional view taken along the line VIII—VIII of FIG. 6.
FIG. 10 is a sectional view taken along the line X—X of FIG. 3 showing another type of damper.

In FIG. 10, there is shown in cross-sectional detail a damper attached upon the presser means 16. The parts of the damper 41 are described in the representation of its mode of operation. Additional dampers 44 and 45 which are rigidly connected with the presser board 26 are shown in more detail in FIG. 9. The function of these dampers is to limit the lowering movement of the presser piston 27 and of the parts connected therewith if, for some reason, no molding or granular material is attached on the pattern device. The dampers 44 and 45 also perform the function of limiting the lowering movement in the case where the annular space 36 becomes devoid of pressure for some reason and can no longer support the weight of the presser piston 27 and of the parts connected therewith in the lifted position. The dampers 44 and 45 will be described in greater detail in connection with their mode of operation.

The presser means 16 and 17 are identical in design and it is to be understood that the description of the pressure means 16 and of its mode of operation is applicable also to the presser means 17.

In the operation of the molding equipment depicted in the drawings, the presser means 16 and 17 bear upon the vibration table 4 over the columns 18 and 19. The coupling member 21 in the columns 22 and 70 is movable to a raised position indicated at 46. In this position, the columns 22 and 70 are in their uncoupled or unlocked condition whereby they are opened. The presser boards 26 and 146 are in the lifted position in accordance with FIG. 1. The lifting device 9 and the arms 8 rigidly connected therewith are in their lowered position indicated at 23. The lifting device 9 receives compressed air through a compressed air line 48 thereby effecting lifting of the lifting device 9 with the arms 8 rigidly connected therewith into the position indicated at 24. The pattern device 6 represented in FIGS. 1 and 2 with the mold 47 arranged thereon is lifted over the bolts 11, 12 and 14. Due to the configuration of the bolt 11, which has the form of a cone, and of the bolt 12, which has prism shaped guide faces which point toward the direction of the bolt 11 while bolt 14 merely has one horizontal bearing surface, the pattern device 6 and the mold 147 is lifted in a precisely defined position.

The locking means of the columns 22 and 70 will be in the unlocked or open position indicated as 46 thereby to define a gap such that the arms 8 may be swung out in the direction of arrow 10. Since the arms are symmetrical and carry on the side of the lifting device 9 remove from the vibration table 4 another pattern device with an additional molding box 7 filled with granular material, the first pattern device 6 with its respective mold 147 is swung out of position from the vibration press after rotation in the direction 10 through an angle of 180° with another pattern device including a mold box 7 filled with granular material being swung into position for compression. It is preferable if one pattern device is provided in the represented application of the invention for molding a lower part with another pattern device being provided for molding an upper part.

Since the invention principally relates to the simultaneous vibratory jarring and squeezing or compression of foundry molds, it is not deemed necessary to describe herein other operations such as the lifting and swinging of the molds from the pattern device, attaching other molding boxes, filling molding boxes with granular material and precompression steps, where necessary. These operations are described in detail in the existing literature of the prior art. Of course, the lifting device 9, which carries the arm 8, may be designed to receive one or a plurality of pattern devices.

Furthermore, since motor drives for driving turntables, as well as lifting devices which perform intermittent rotation through angles of 90° or 180° are known and have been described, further detailed description thereof will be unnecessary. It will be seen, however, that a motor drive 49 is provided for the lifting device 9 in order to perform the necessary operations in accordance with prior art techniques within the knowledge of those skilled in the art.

After an additional pattern device with its respective molding box 7 has been filled with granular material and swung in over the vibration table 4, locking and unlocking of the coupling means of the columns 22 and 70 may be perfomed. When a cylinder 50 receives compressed air, it will operate to move the coupling member 21 out of the position 46 and into a position 51. In this position, cam surfaces 52 strike against a damping ring 53 which bears upon a bush 54 which is rigidly connected with a support 55. The support 55 is rigidly connected with the vibration table 4. A rotating bush 56, which is arranged in the bush 54 and which is held axially by a disc 57, includes a gearing 58 which meshes with the counter-teeth of the coupling member 21 in position 51. The bush 56 includes a bore 96 through which impurities which have accumulated within the parts provided within the support 55 may escape. A lever 59, rigidly connected with the bush 56, is attached through a tongue 60 to a piston rod 61 of a cylinder 62. By reversal of the cylinder 62, the lever 59 may be turned from a position 63 into a position 64 thereby effecting turning of the coupling member 21 so that cams 65 of the coupling member 21 are brought between cams 66 of damping ring 63, while cams 67 of coupling part 21 are brought between cams 68 and 69 of column 22.

In this position, the column 22, which is rigidly connected with the presser means 16, is connected in locked engagement through the support 55 to the vibration table 4 thereby forming together with the column 18 a rigid frame which includes the presser means 16, column 18, the vibration table 4 and the locking means which are configured to include the clasping means 20, the hollow column 22 and the vertically displaceable rod 72. Thus, it will be seen that the presser means 16 and the vibration table 4 may be coupled in a rigid framelike structure by coupling means which include the rigid column means 18 and the locking means comprising the coupling member 21.

Since the cams 65 of the coupling member 21 lie between the cams 66 and the damping ring 53, and since the cams 67 of the coupling member 21 lie between the cams 68, 69 of the column 22, the locking or coupling effect which is thus established is capable of transmitting both tensile and compressive forces. Thus, these forces may be appropriately applied during operation to the rigid frame which is formed by the assembly including the vibration table 4, the columns 18 and 22, and the presser means 16.

In a similar fashion, the vibration table 4 forms together with the rigid column means 19 and the presser means 17, as well as the column 70 over the respective support members, a comparable rigid frame structure when the coupling means are in the locked position in an arrangement similar to that described above.

If the coupling means of the columns 22 and 70 are to be opened, the cylinder 62 is operated in a reversed manner thereby bringing the lever 59 out of its position 64 and into a position 63. The coupling member 21, which is in an operative connection with the lever 59 over the gearing 58 and the bush 56, is thus rotated. The coupling member 21 is then located in a position in which the cams 65 and 67, coincide with gaps located between the cams 66, 68 and 69. In this position, by reversing the operation of the cylinder 50, the coupling member 21 may be lifted from its position 51 into the position 46.

In order to prevent rotation of the coupling member 21 relative to the column 22 and the cam 66 of support 55 during the lifting and lowering motions, a wedge member 71 is arranged in the bore of the hollow column 22 which coincides with one of the cams 69 thereby securing the coupling member against rotation over a gap between the cams 67 during its entire stroke, even prior to disengagement of the gearing 58. The coupling rod 72 of the cylinder 50 is rotatable within the coupling member 21.

The locking means depicted in FIGS. 4 and 5 may be replaced in another embodiment of the invention by other locking means which are depicted in FIGS. 6, 7 and 8. In the embodiment of FIGS. 6, 7 and 8, a support member 73 is rigidly connected upon the vibration table 4 by screws 74. A shaft 75 is rotatably mounted within bores 76 and 77 and carries a bush 78 which has a swiveled coupling lever 25 affixed thereto with a toothed segment 79 being also positioned upon the bush 78. The toothed segment 79 engages a rack 80 which may be displaced by operation of a piston rod 81 operated by means of a cylinder 82. The cylinder 82 is mounted by a bolt 83 to the support member 73 and piston rod 81 is guided for movement by a guide member 84. Displacement of the rack 80 will operate to move the swivel lever 25 in a reciprocal fashion between a position 85 and a position 86, the positions 85 and 86 being determined by corresponding stroke limitations of the cylinder 82. A pair of members 90 and 91 are rigidly connected with a column 88 and coupling surfaces 87 and 89 are so selected that their distance 92 is smaller than a distance 93. This facilitates movement of the swivel lever 25 from position 86 into position 85 and it also facilitates return of the swivel lever 25 into position 86. It will thus be seen that the device is formed to provide a tongue-in-groove locking arrangement between the swivel lever 25 and the column 88.

In the operation of the coupling means according to the embodiment of FIGS. 6-8, if the swivel lever 25 is in position 86, an opening or gap exists between an upper edge 94 of the vibration table 4 and a bottom edge 95 of the parts 90 and 91 of the column 88, which gap is adapted to enable the passage therethrough of the arms 8. Thus, the arms 8 may swing out in the aforedescribed manner and a pattern device with its respective mold 147 may brought into appropriate position. Also, the arms may be operated to swing in another pattern device with a molding box 7 filled with granular material which may be positioned over the vibration table 4. While the pattern device is deposited on the vibration table 4 by lowering the lifting device 9 from position 24 into position 23, the cylinder 82 is reversed and thereby moves the coupling lever 25 from position 86 into position 85. In position 85, the column 88 is frictionally locked or connected through the swivel lever 25, shaft lever 75 and support 73 with the vibration table 4. The difference between the distances 92 and 93 and between the surfaces 87 and 89 is so selected that the swivel lever may be moved into position 85 without making too great a demand upon the accuracy of the dimensions of the column 88, the parts 90, 91 and the swivel 25. The difference must not under any circumstances be so great that the surface pressing on the side of the distance 92 differs for too great a degree from the surface pressing on the side of the distance 93. The coupling means including the locking means in accordance with FIGS. 6–8 is also capable of transmitting both tensile and compressive forces within the rigid frame formed thereby.

Thus, it will be seen that the design of the coupling means including the locking means comprising columns 22 and 70 need not be limited to the embodiment described in connection with FIGS. 4 and 5 and that according to FIGS. 6, 7 and 8 other locking means may be provided with special embodiments being formed which may safely and rapidly disengage and lock as required.

The presser means 16 and 17 of the invention are depicted in more detail in FIG. 3 and in their operation, when the lifting device 9 has swung the arm 8 to place a pattern device 6 and a molding box 7 filled with granular material over the vibration table 4, and after the mold has been lowered upon the vibration table 4, the couplings of the column 22 and 70 may be locked in the manner previously described. During these operations, the presser boards 26 and 146 and the parts connected therewith are in the raised position 97 shown in FIG. 3, with reference also being made to FIG. 1. The position 97 is reached by virtue of the fact that, on the one hand, the annular space 36 is constantly maintained under pressure through the compressed air supply 35 while, on the other hand, the interior 32 of the cylinder is made devoid of pressure through the compressed air line 30 by a setting of the valve 31 to enable an exhaust operation. In this manner, the space 34 above the presser piston 28, which is permanently connected over the duct 33 and the interval 98 with the cylinder interior 32, is also made devoid of pressure. The packings 38 and 39 provide the function of sealing the annular space 36 in the aforedescribed state. By reversing the valve 31, the exhaust is closed and the compressed air line feeds compressed air to the cylinder interior 32 and the spaces connected therewith. The presser board 26, the piston 27 and all the parts connected directly therewith move downwardly from a position 97, seen in FIG. 1, into a position 99. It is advantageous if this lowering movement occurs at a very high speed and if the descending parts, including the presser boards 26 and 146 and the parts connected therewith are made to comprise members of substantial weight. In this fashion, between equalization of the compaction of the granular material is achieved above the patterns and between the patterns as well as along the inner wall of the molding box. This equalization is due to the fact that a rapid presser blow during the start of compression, by simultaneous vibration and compression, allows air contained within the granular material to rise briefly at points of higher compression under a higher pressure than at points of lower compression. The flow of air from areas of higher compression to areas of lower compression will operate to likewise effect a displacement of te granular material in the direction of the air flow.

After the compression process has been started, compressed air is supplied to a compressed air line 100 by actuating a valve (not shown) so that a vibratory movement of the vibration table 4 and of the presser means 16 and 17 connected therewith will be initiated. During this vibration, the vibration table 4 forms a closed frame with each of the presser means 16, the columns 18 and 22 and the respective coupling and locking means, as well as with the presser means 17, the columns 19 and 70 and their respective coupling and locking means.

It has been found that during the simultaneous vibration and compression, the weight of the presser boards 26 and 146, as well as of the parts connected therewith, substantially influence the amount of compression which occurs. If the weight of the presser boards 46 and 146, as well as of the parts connected therewith is selected to be of a higher magnitude, compression increases. With a lower weight the compression of the granular material decreases with constant compression of the pressure means 16 and 17 and with constant vibration of the vibration table 4. The increase of the weights which bear directly on the granular material during the vibratory motion results not only in an increase in compression but beyond that also in equalization of the compression.

During the time that the presser board 26 and the presser piston 27 move vertically, the presser board 26 is secured against rotation by the guide member 42 and by a guide bar 43 secured upon the presser board 26. A guide 101 effects a similar function for the presser means 17.

After execution of the compression and vibration, the compressed air line 100 is set to exhaust and the vibratory process is thus ended. Subsequently, by switching the valve 31 to exhaust, the compressed air supply 30 is interrupted and the cyliner interior 32 and the spaces connected therewith become devoid of pressure. The annular space 36, which remains under pressure through the compressed air supply 35, lifts the presser board 26 and the parts connected therewith out of position 99 and into position 45. The press is thus again in its starting position. In the vibratory operation of the device, the columns 18 and 22 and 19 and 70, respectively, as well as the cylinder 37 and that of the presser means 17 bear upon the vibration table 4. During an applied impulse, acceleration forces act on these parts which exceed by a hundred times the forces of acceleration due to gravity. It is therefore advantageous to make these parts of lightweight material. It will be apparent that despite the fact that in FIGS. 1 and 2 the vibration table 4 is depicted with two presser means 16 and 17, the invention is not to be so limited and the number of presser means for each vibration table may be different. It is possible of course to provide only one presser means for a vibration table or more than two presser means for each vibration table.

Since the weight of the presser board and of the parts rigidly connected therewith should be selected to be as high as possible, as mentioned above, the invention provides a limitation on the lifting movement by the installation of a damper 41. Damper 41 limits the upward movement of the presser board 26 and of the presser board 146, respectively, during lifting from the position 49 into position 97.

As shown in FIG. 10, the damper means 41, which is a hydraulic damper, includes a member 102 rigidly connected through a member 103 to a cylinder shell 104 with a bolt 106 being provided in a bore 105 which is designed at its lower end as a piston 107. In the bolt 106 there are provided bores 108 which connect the underside of the piston 107 with a space above piston 107. A valve ball 109 is pressed by a spring 110 to the bore 108 so that the bore 108 can only be transversed in a direction 111. An oil vessel 112, which is filled up to level 113 with oil, is carried by a bolt 114 which is guided in a bore 115 and is sealed by a packing means 116 from the space 34. A spring 117 presses upon the oil vessel 112 and thus brings the bolt 114 permanently to bear upon the damping rod 40, which is also seen in FIG. 3. If the presser board 26 is moved from position 97 into position 99, the spring 117 urges the oil vessel 112 into a position 118. The oil in the vessel 112 flows through bores 108 into a vacant hollow space below the piston 107 and presses the valve ball 109 against the pressure of spring 110 away from bore 108.

When the presser board 26 and the parts connected therewith are raised from position 99 into position 97 the damping rod 40 is also raised and the valve ball 109 closes the bore 108. The oil contained in the space under the piston 107 can only flow through a groove 119 provided in piston 107 from the space beneath piston 107 back into the oil vessel 112. Since 119 narrows in its flow section in a squared ratio from a piston underside 120 to a piston topside 121, a constant braking force is produced in the space beneath the piston 107 when the speed of the presser board 26 and of the parts connected therewith is reduced.

Since the length of the braking path of damper 41 corresponds to the difference between the position 118 and a postion 122, the resulting braking force may be freely selected. It is advantageous to select the braking force such that the coupling on the portion side of the columns 22 and 70, respectively, can be already opened during the lifting movement of the presser boards 26 and 146 without excess load being produced on the columns 18 or 19 by inertia forces.

It has been found in practice, that despite preventive measures, there exists no assurance that compressed air flow through the compressed air line 30 to the cylinder interior 32 and into the spaces connected therewith may be avoided when no molding box 7 filled with granular material is in position bearing on the pattern device 6. The dampers 44 and 45, which will be described below, provide the function of avoiding damage to the apparatus when such undesired air flow occurs. Additionally, these dampers perform a function such that, if there is no pressure in the compressed air supply 35 during idle periods and while special repairs are being made, they limit the descending path of the presser board 26 and of the parts connected therewith.

The dampers 44 and 45 are depicted more fully in FIG. 9 as comprising a cylinder 123 rigidly connected with the presser board 26 or 146 over an intermediate plate 124. A piston rod 125, which includes a piston 126 at its lower end, is displaceably mounted in cylinder 123 and in a cylinder attachment 126. A spring 128, which bears upon a member 129 secured in the cylinder attachment 127, urges the piston 126 with its piston rod 125 into the position shown in FIGS. 1 and 9. In the cylinder 123, a duct 130 connects a space 131 existing between the piston 126 and the intermediate plate 124 with a space 132 which is filled to a level 133 with oil. Ducts 134 arranged in piston 126 connect a space 135 with space 131. A valve ball 136 closes ducts 134 so that they can only be traversed by oil in a direction 137. Ducts 138 connect ducts 134 with the space 131. A bore 148 in the member 129 serves to exchange air during variation of the level 133, and a ring 149 bearing thereon prevents entrance of dust. If the presser means 16 and 17 operate in their normal state, the dampers 44 and 45 will not be actuated. During normal operating functions, stop flange 139 moves from a position 140 into a position 141 and back again. Only when the descending movements of the presser board 26 begin with no mold 147 on the pattern device or with no molding box filled with granular material in position, is the descending movement limited by the fact that an underside 142 of stop flange 139 strikes against the counter surface 142 of the presser means 16 or 17. This causes the piston 126 to move in a direction 144 and thus force oil to flow over a groove 145 from space 135 into space 131. The valve ball 136 prevents oil from flowing off over the ducts 134. The cross section of the duct 145 narrows in a squared ratio. The dampers 44 and 45 thus exert a constant decelerating force on the descending movement until the piston 126 is so far elevated that it has displaced the entire oil volume of the space 137.

In a situation where the molding machine as described above is equipped with only one presser means 16, 17, the compressed air line 100 may be eliminated and the vibration table 4 may form a fixed compression table.

It will thus be seen from the foregoing, that the present invention eliminates many of the disadvantages of the prior art by providing the pattern device with the molding box attached and filled with sand with an arm which can be moved into and out of the vibration press, and by rigidly connecting the press by at least one column with the vibration table while providing at least a second column which may be locked and unlocked by means of a locking device with the vibration table. Locking means operate in a manner whereby they may be separated to form an opening extending across the columns which form a portal with the press. This provides an effect wherein the lifting and rotating device may be centrally arranged and may operate to carry several pattern devices spaced by equal intervals. Furthermore, the compaction may be effected by compression and/or vibration with the masses to be moved during operation being smaller than otherwise necessary. Furthermore, the size and weight of large structural parts may be significantly reduced while, additionally, driving forces necessary to power the equipment may be reduced with reduction in the costs which are necessary for maintaining and operating such equipment. It is particularly noteworthy that, due to the rigid action of the press with the vibrating table, no exchangeable surfaces exist at the connecting points between the press and the mold table.

It will be seen that in one embodiment of the invention the coupling means may be provided with locking means which comprise a displaceable part having a bayonet lock or one which is designed as a swiveled or rotatable lever which may be swung into a mating coupling member at its outer end in the manner of a tongue-and-key arrangement. These special embodiments have the advantage that they may be actuated within very short periods of time and therefore increase the output of facilities utilizing the device.

In other embodiments of the invention there are provided dampers for limiting the stroke of the presser means. Therefore, advantages may be provided in that coupling of one side of the frame or portal formed in the device may already be opened during the stroke of the presser piston without forces due to inertia appearing at the end of the stroke which might overstress the existing unilateral connection of the press with the vibration table.

Furthermore, it will be seen that the dampers which are provided for stroke limitation operate in both directions of motion of the presser board and of the part connected therewith. This has the further advantage that in cases where lowering movements of the presser means are started where neither a molding box nor a box filled with granular material is in place on the pattern device, pattern device will not be damaged nor will any damaged be caused to the portal supporting the press by over-stressing. The damping of the lowering movements permits increase particularly with regard to the mass of the press plunger and of the compression board by a multiple amount and enables selection of the lowering rate of the presser piston at a particularly high level. This provides another advantage in that the compression or compaction of the granular material will be more uniform in horizontal directions. The reasons for this unexpected effect are that the mold filled with granular material has a substantially lower bulk weight than the fully compressed mold and that when a presser board of substantial weight is impacted upon the upper side of the granular material, a sudden pressure increase of air contained within the granular material will effect horizontal equalization of distribution of the material.

While specific embodiments of the invention have been shown and described in detail to illustrate the application of the inventive principles, it will be understood that the invention may be embodied otherwise without departing from such principles.

What is claimed is:

1. Molding apparatus for squeezing and jolting foundry molds comprising, in combination, a jolting table adapted to have molds placed thereupon, means operatively connected with said jolting table for jolting said table, presser means including a presser plate and pressure applying means located at a spaced distance above said jolting table, said presser means being movable between an uppermost position to permit placement of said molds between said jolting table and said presser plate and a lowermost position for applying a squeezing force to molds placed between said jolting table and said presser plate, arm means located adjacent said table and adapted to have said molds supported thereon, mounting means effecting rotation of said arm means for moving said molds into and out of position between said jolting table and presser plate, and column means extending between said presser means and said jolting table to enable formation of a rigid frame assembly including said jolting table and said presser means, said column means including a first column rigidly interconnecting said presser means with said jolting table and a second column including locking means movable between a locked and an unlocked position, said locking means when in said unlocked position forming a gap between said second column and said jolting table to enable said arm means to be rotated through said gap for placement of said molds between said jolting table and said presser plate, said rigid frame assembly being adapted to be jolted as a unit by said means for jolting said jolting table while said mold is being squeezed between said jolting table and said presser plate with said locking means in the locked position.

2. Apparatus according to claim 1 wherein said locking means comprise a displaceable bayonet lock.

3. Apparatus according to claim 1 wherein said locking means comprise a rotatable swiveled lever and a locking member releasably engageable therewith, said swiveled lever and said locking member being configured to form a tongue-in-groove locking arrangement.

4. Apparatus according to claim 1 including damper means for damping and limiting movement of said presser means.

5. Apparatus according to claim 4 wherein said damper means comprises dampers for limiting movement of said presser means in two directions between said uppermost and said lowermost positions thereof.

6. Apparatus according to claim 4 wherein said damper means include a hydraulically operated damper located adjacent said pressure applying means and effective for operative engagement therewith to damp and limit upward movement of said presser plate.

7. Apparatus according to claim 4 wherein said damper means include a pair of hydraulically operated dampers for damping and limiting downward movement of said pressure plate.

8. Apparatus according to claim 1 wherein said arm means comprise generally horizontally extending arms and wherein said mounting means comprise means for rotating said arms about a substantially vertical axis.

9. Apparatus according to claim 1 wherein said pressure applying means comprise pneumatically operated piston means for moving said presser plate into and out of compressive engagement with said mold.

10. Apparatus according to claim 1 wherein said locking means include vertically displaceable rod means, hollow column means rigidly connected to said presser means having said rod means mounted therein for longitudinal and rotative displacement relative thereto, clasping means mounted upon said jolting table and adapted to have said rod means releasably locked therewith, interengagement means extending betweene said hollow column means and said rod means and between said clasping means and said rod means, said interengagement means being configured to enable longitudinal displacement of said rod means relative to both said hollow column means and said clasping means but to effect locking engagement therebetween upon relative rotation of said rod means within said hollow column means, said rod means being rotatable and longitudinally movable into and out of locking engagement between said hollow column means and said clasping means whereby said gap may be formed by longitudinal movement of said rod means out of locking engagement with said clasping means.

11. Apparatus according to claim 1 wherein said locking means comprise a swiveled lever pivotally mounted upon said jolting table, interengagement from said presser means including a tongue-in-groove arrangement extending from said presser means for locking engagement with said swiveled lever, and means for pivoting said swiveled lever relative to said jolting table into and out of locking engagement with said tongue-in-groove arrangement whereby said gap may be formed by rotation of said swiveled lever into said unlocked position.

12. Apparatus according to claim 11 wherein said locking means include gear means mounted upon said swiveled lever, a toothed rack arranged for operative engagement with said gear means to effect pivotable rotation of said swiveled lever, and hydraulic means operatively associated with said toothed rack and mounted in fixed engagement with said jolting table to effect displacement of said toothed rack to move said swiveled lever into and out of locking engagement with said tongue-in-groove arrangement.

* * * * *